United States Patent [19]

Fischer

[11] 4,306,677

[45] Dec. 22, 1981

[54] RAIL FASTENER

[75] Inventor: Richard L. Fischer, Bolingbrook, Ill.

[73] Assignee: Portec, Inc., Oak Brook, Ill.

[21] Appl. No.: 112,319

[22] Filed: Jan. 15, 1980

[51] Int. Cl.[3] ..... E01B 9/30
[52] U.S. Cl. ..... 238/349
[58] Field of Search ..... 238/310, 338, 349, 351

[56] References Cited

U.S. PATENT DOCUMENTS

| | | | |
|---|---|---|---|
| 2,266,295 | 12/1941 | Armstrong | 238/349 |
| 2,275,129 | 3/1942 | Cantrell et al. | 238/349 |
| 2,724,558 | 11/1955 | Jones | 238/349 X |
| 3,460,256 | 8/1969 | Sanson | 238/349 X |
| 4,067,495 | 1/1978 | Qureshi | 238/349 |
| 4,111,361 | 9/1978 | Sonneville | 238/349 X |

FOREIGN PATENT DOCUMENTS

| | | | |
|---|---|---|---|
| 195841 | 5/1965 | Sweden | 238/349 |
| 2006308 | 5/1979 | United Kingdom | 238/349 |

*Primary Examiner*—Randolph A. Reese
*Attorney, Agent, or Firm*—Emory L. Groff, Jr.

[57] ABSTRACT

A rail fastener includes a shoulder member fixed relative a cross-tie and having a head insertable through an apertured insulator. One end of the insulator bears upon the cross-tie while the opposite end carries a dielectric pad engaging the top surface and lateral edge of a rail base flange. The fastener assembly is completed by the application of a spring clip attached to the shoulder head and constantly bearing downwardly against the two opposite ends of the insulator. The dielectric pad surrounds a substantial portion of one end of the insulator and preferably is staked thereover but alternatively may be secured by a press fit, shrink fit, snap fit or by suitable adhesive.

17 Claims, 7 Drawing Figures

RAIL FASTENER

This invention relates generally to railway appliances, and more particularly, to an improved rail fastener particularly adapted for use with concrete cross-ties.

Various devices have been produced over the years for the purpose of retaining a rail in position on a cross-tie with the aim of reducing longitudinal creeping of the rail as well as restricting the vertical displacement or wave motion of the rail during passage of traffic thereover. The instant device accomplishes the foregoing by means of an insert or shoulder member fixedly attached with respect to the cross-tie on both the field and gage sides of a rail base and which serves to longitudinally and transversely stablize a captive insulator including a metal plate having a first distal section overlying the cross-tie and an opposite, second distal section overlying the rail base flange. The insulator is biased downwardly into constant engagement with the cross-tie and rail flange respectively, by means of a unitary spring clip having alternate portions engaging the shoulder member and the two distal sections of the insulator.

An earlier example of a rail fastener comprising a shoulder member cooperating with a spring element and an insulator is shown in the patent to Ruble, U.S. Pat. No. 3,887,128 issued on June 3, 1975 and assigned to the owner of this invention. In the referenced patent, the deflectable spring element is retained in position with respect to the shoulder member by means of a rigid non-deflectable removable pin as opposed to the present arrangement wherein the insulator plate is resilient as well as is the spring clip retaining it in position. Additionally, the present device proposes an insulator comprising a unitary assembly of the resilient metal plate and a dielectric pad thereby discouraging the separation or relative shifting between these two elements, which has been a decided problem in many prior art devices involving a rail clip element combined with a dielectric insulating component.

The spring clip found to be more efficient in retaining the insulator of this invention in its use position comprises a unitary, symmetrically configured clip such as that shown in the patent to Qureshi, U.S. Pat. No. 4,067,495 issued Jan. 10, 1978 to the same assignee as the present invention. The referenced clip is highly advantageous in view of its symmetrical configuration which allows its application to a rail insulation from either side of a shoulder member and insures the provision of a powerful, equal downward force as the two outside portions of the spring clip respectively engage the distal rail and tie sections of the insulator.

Accordingly, one of the objects of the present invention is to provide an improved rail fastener including a shoulder member secured to a cross-tie with an insulator surrounding the shoulder member and provided with opposite rail and tie engaging sections respectively downwardly urged by means of two portions of a unitary spring clip having legs engaging the shoulder member.

A further object of the present invention is to provide an improved rail fastener including an insulator comprising an inner rail section overlying a rail base flange and an outer tie section overlying the cross-tie and wherein the inner rail section carries a dielectric pad affixed thereto to electrically isolate at least the undersurface of the rail section from the juxtaposed rail base flange.

Another object of the present invention is to provide an improved rail fastener including an insulating having a central aperture closely surrounding a shoulder member affixed to a cross-tie with the insulator having an inner section overlying a rail base flange with a dielectric pad affixed to at least the undersurface of the inner rail section and having a downwardly directed flange overlying the edge of rail flange intermediate the rail and shoulder member.

Another object of the present invention is to provide an improved rail fastener including an apertured insulator plate closely surrounding a shoulder rigidly attached to a cross-tie with a dielectric pad frictionally secured to one end of the insulator and having a pair of co-planar flanges along one edge with one of the flanges engaging an edge of the insulator plate and the other flange extending between the rail base edge and the shoulder.

With these and other objects in view which will more readily appear as the nature of the invention is better understood, the invention consists in the novel construction, combination and arrangement of parts hereinafter more fully described, illustrated and claimed.

Similar reference characters designate corresponding parts throughout the several figures of the drawings.

Figure 1:
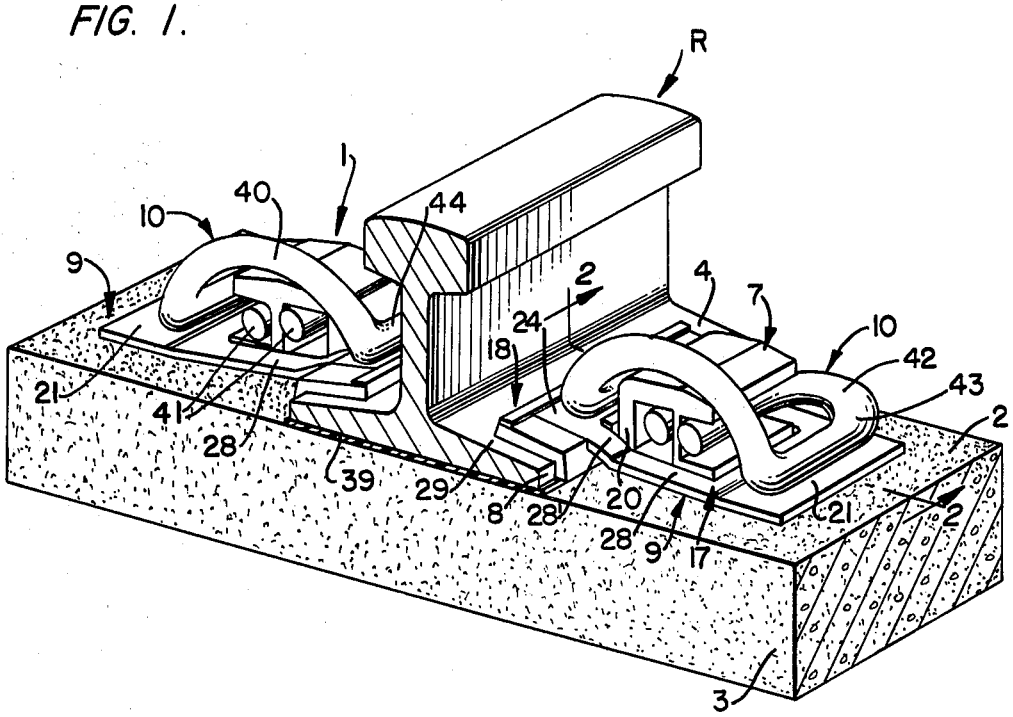
FIG. 1 is a top perspective view illustrating a rail fastener according to the invention.
Figure 2:
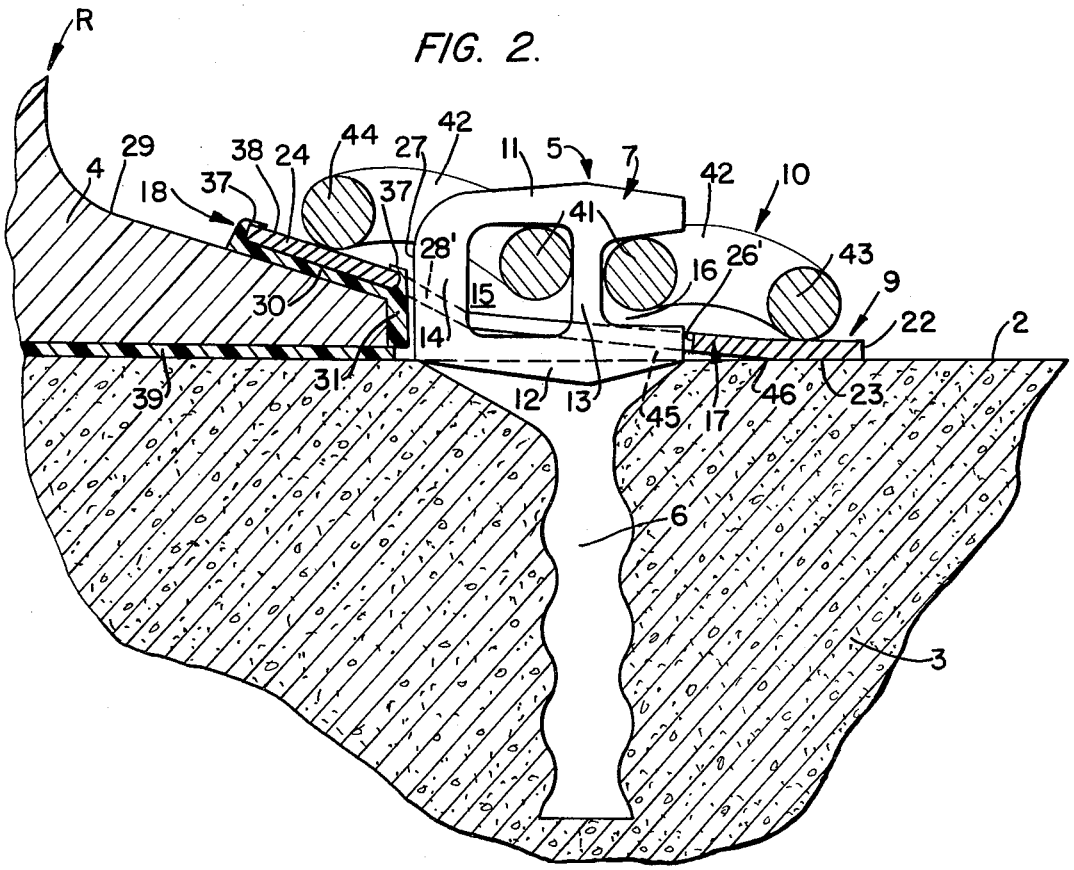
FIG. 2 is an enlarged side elevation, partly in section of one of the rail fasteners shown in FIG. 1.
Figure 7:
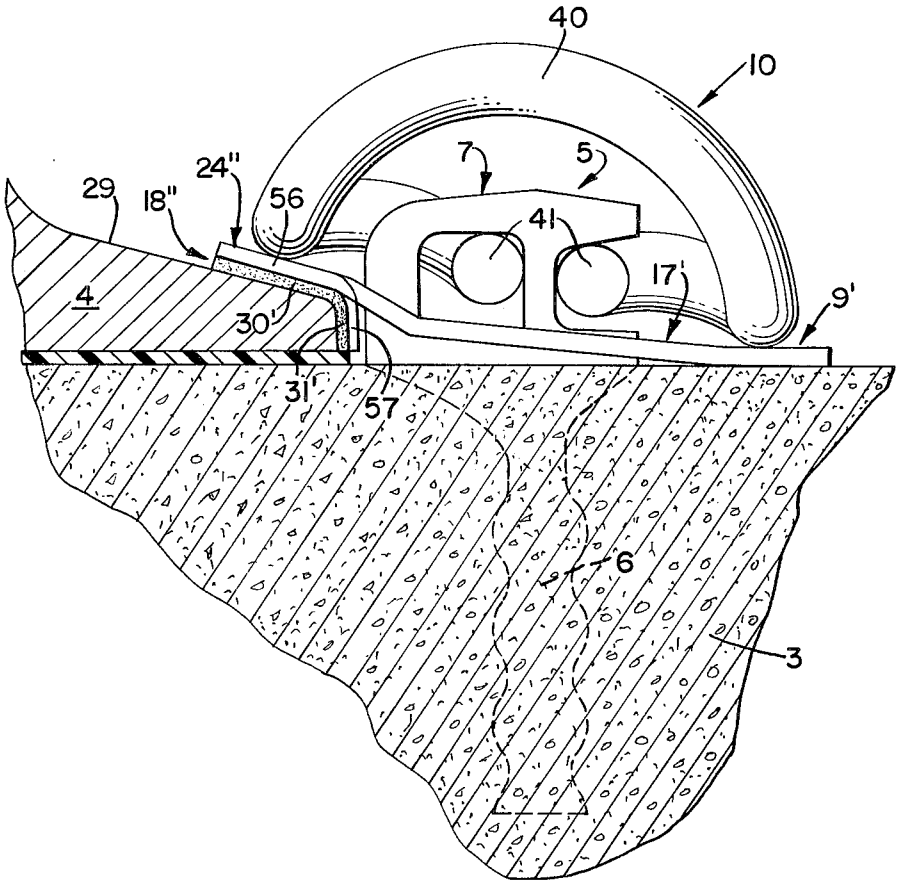
FIG. 7 is a side elevation of a further modification of the present invention.

Referring now to the drawings, particularly FIG. 1, the present invention will be seen to comprise a rail fastener generally designated 1, adapted to be disposed adjacent the top surface 2 of a cross-tie 3 juxtaposed each base flange 4 of the rail R. In the embodiment of FIGS. 1, 2 and 7, the fastener 1 is associated with a cross-tie 3 formed of a castable substance such as concrete or synthetic plastic and the fastener assembly includes an insert or shoulder member 5 having a shank 6 confined within the body of the cross-tie so as to securely retain the integral head 7 in a fixed manner adjacent each rail base flange edge 8.

The shoulder member 5 serves two purposes. Not only does it retain an apertured insulator 9 in a fixed longitudinal and transverse position but it also serves as stationary means for the subsequent mounting and retention of a spring clip 10. The shoulder member head 7 will be seen to project upwardly from the cross-tie surface 2 to a distance greater than the vertical extent of the adjacent rail base flange edge 8 and includes a cap 11 joined to a platform 12 adjacent the top of the cross-tie by means of a web 13 which is substantially vertically aligned with the center axis of the shank 6, and by an inner wall 14 juxtaposed the rail base flange edge 8.

Figure 3:
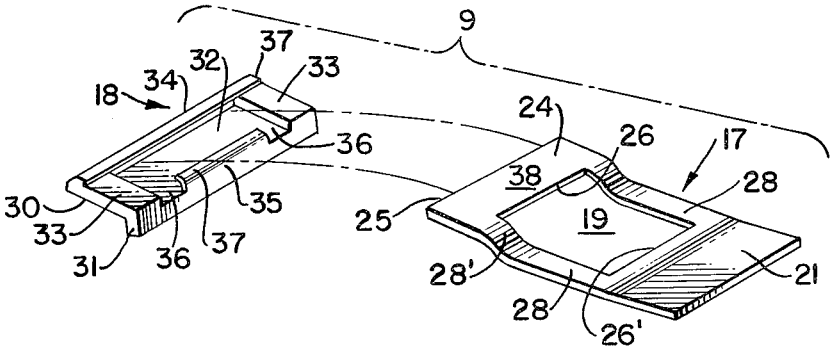
FIG. 3 is an enlarged exploded perspective view of the insulator shown in FIG. 1.
Figure 4:
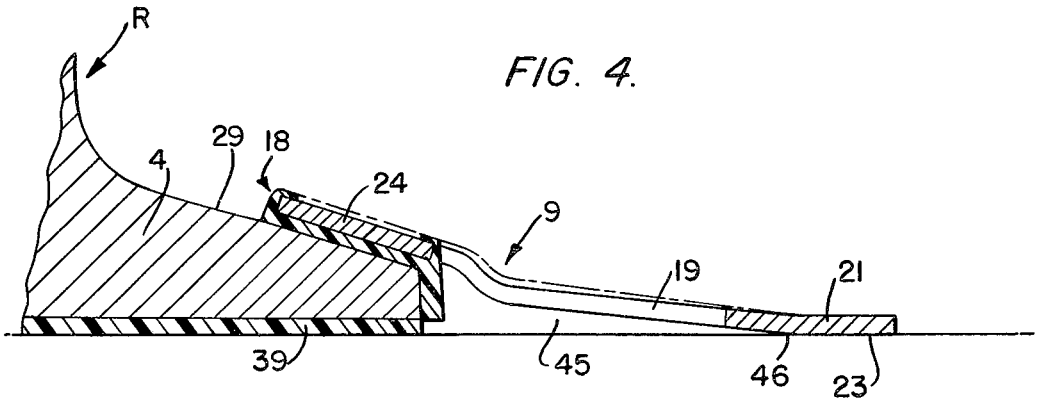
FIG. 4 is a side elevation illustrating typical alternate positions of the resilient insulator during travel over the rail.

As shown most clearly in FIG. 2 of the drawings, the aforementioned web 13 and inner wall 14 are both parallel to the running length of the rail R and define an adjacent enclosed cavity 15 and open cavity 16, the purposes of which will be described hereinafter. Alternatively, a single enlarged cavity may be employed as shown in FIGS. 3 and 7 of the above referenced U.S. Pat. No. 4,067,495.

Cooperating with the shoulder member 5 is the insulator 9 comprising a rectangular assembly of a metal plate 17 secured to a dielectric pad 18. The plate 17 possesses limited resilience and is provided with a centrally disposed aperture 19 formed to provide a close surrounding fit about the similarly rectangularly configured periphery 20 of the shoulder member head 7. The insulator 9 includes, adjacent one end of the aperture 19, an outer tie section 21 having a distal edge 22 and an underlying tie bearing surface 23. Adjacent the opposite end of the insulator aperture 19 is an inner rail section 24 having a distal edge 25 disposed well inwardly of the base flange 4 from its edge 8 and having an inner aperture edge 26 extending along a line intermediate the rail base flange edge 8 and the gage surface 27 of the shoulder member inner wall 14. The lateral limits of the insulator aperture 19 are defined by the parallel side sections 28—28 joining the metal plate outer tie section 21 and inner rail section 24 while the remaining boundary is defined by an outer aperture edge 26'.

As shown most clearly in FIG. 3 of the drawings, the dielectric pad 18 is constructed of any suitable insulative composition exhibiting dimensional stability in order to insure maintenance of satisfactory electrical isolation between the metal plate 17 and the rail top surface 29 as well as the rail base flange edge 8 of the rail R. The pad 18 shown in FIGS. 1–4 comprises a unitary element including a rectangular base 30 having along one longitudinal edge an integral downwardly directed flange 31, the vertical height of which is at least equal to that of the rail base flange edge 8. The upper surface of the pad base 30 is provided with a cavity 32 the longitudinal and transverse dimensions of which are substantially equal to those of the metal plate inner rail section 24. The edges of this cavity 32 are defined on the one hand by two end walls 33—33 of substantial longitudinal extent and by means of a first edge wall 34 and a second edge wall 35. The two ends of the second edge wall 35 stop short of the respective end walls 33 to provide a pair of transverse channels 36—36 having a longitudinal extent substantially equal to the corresponding dimension of the side sections 28 of the insulator 9. The first and second edge walls 34 and 35 of the dielectric pad 18 are preferably initially formed with a height greater than the depth of the cavity 32 so that following insertion of the metal plate inside rail portion 24 into the confines of the cavity 32 the upper portions of these two edge walls 34–35 may be deformed or staked as at 37 to provide an overlying portion of the pad 18 engaging the top surface 38 of the inner rail section 24.

From the above it will be seen that an insulator 9 is provided comprising a unitary assembly of the resilient metal plate 17 and the captively applied dielectric pad 18 so that when the insulator is installed as shown in FIGS. 1 and 2 of the drawings, the rail base flange 4 is electrically isolated from both the shoulder member 5 and the retaining spring clip 10. This electrical isolation will be understood to be completed by the utilization of an appropriate insulative tie pad 39 beneath the rail base as is well known in the art.

Installation of the fastener 1 of the present invention is accomplished by lowering each insulator 9 about the head 7 of the shoulder member 5 after which the spring clip 10 is applied. This clip may be configured according to the earlier referenced U.S. Pat. No. 4,067,495 and will be seen to comprise a pair of substantially horizontally disposed symmetrical U-shaped elements joined by a vertically disposed loop or cross-over member 40. Each U-shaped member comprises an inner leg 41 joined to either an outside tie portion 43 or an inside rail portion 44, respectively. The symmetrical configuration of this clip 10 when viewed in plan will be understood to define a configuration suggesting a B-shaped integral clip. The clip is applied to the balance of the rail fastener assembly 1 by inserting its two legs 41—41 respectively into the cavities 15 and 16. Any suitable well known tool (not shown) may be employed to facilitate the necessary downward deflection and subsequent longitudinal displacement of the clip legs as the two portions 43–44 slide over the two insulator sections 21 and 24.

When inserted as above, it will be understood that the outside tie portion 43 will bear on the top of the outer tie section 21 of the insulator while the inside rail portion 44 similarly bears upon the top of the inner rail section 24 of the insulator. In view of the substantial downward force required to displace the legs 41—41 of the clip 10 during its installation with the shoulder member 5, it will follow that a substantial force will thus be conveyed by means of the stressed end connecting portions 42 and the loop member 40, which force is thus transmitted as a constant downwardly biasing force by the outside tie portion 43 and inside rail portion 44 which two portions respectively constantly urge the insulator outer tie section 21 against the cross-tie and the inner rail section 24 and its affixed pad 18 against the rail base flange 4.

The pressure of the base 30 of the insulating pad 18 is most equally distributed against the rail base flange 4 by locating its longitudinal center-line substantially beneath the overlying inside rail portion 44 of the spring clip and similarly, the longitudinal extent of the clip outside tie portion 43 substantially overlies the longitudinal center-line of the tie bearing surface 23 of the insulator outer tie section 21. As shown most clearly in FIG. 2 of the drawings, the metal plate 17 is angularly disposed in an upward direction from the tie bearing surface 23 so as to provide the clearance 45 between the insulator and the cross-tie top surface 2, which arrangement isolates and concentrates the area of the surface contact between the insulator and the cross-tie. The inside edge 46 of the planar tie bearing surface will be seen to stop short of the outside edge 26' of the aperture 19 and from this point inwardly the body of the plate 17, including the majority of the side sections 28—28, is inclined upwardly in a substantially straight line to a point juxtaposed the shoulder inner wall 14 and its juncture with the cavity 15. From this area the two side sections 28 are inclined upwardly a greater degree, as reflected by the portions 28', and thence connect with the planar inner rail section 24, the latter of which will be seen to be inclined a lesser degree than the side section portions 28'.

Figure 5:
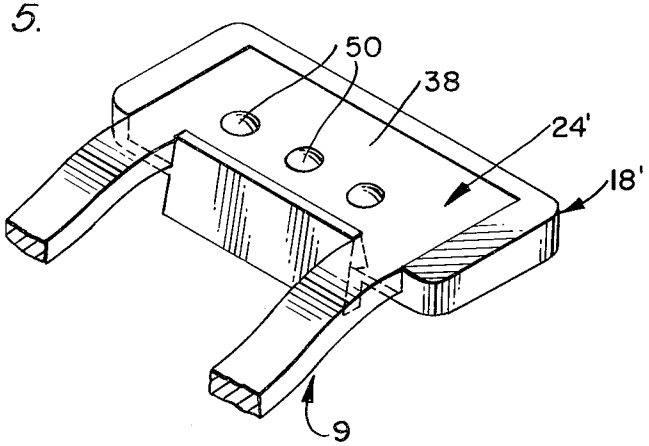
FIG. 5 is a fragmentary perspective view of an insulator having a modified dielectric pad.
Figure 6:
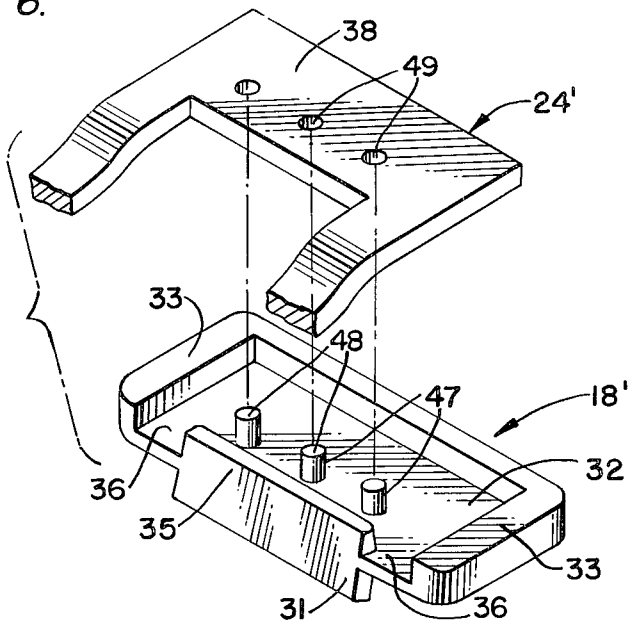
FIG. 6 is an exploded view of the insulator of FIG. 5 prior to assembly.

In the embodiment of FIGS. 5 and 6, instead of staking the edges 34–35 as with the pad 18, alternate means are provided for insuring the rigid attachment of the dielectric pad 18' to the insulator plate 17. In this instance the first edge wall 34 and the second edge wall 35 need only extend upwardly from the base of the cavity 32 a distance which is equal to the thickness of the inner rail section 24'. In other words, the top surface of the four walls defining the outer limits of the cavity 32 may be constructed to be disposed in a common plane which will be co-planar with the top surface 38 of the insulator plate inner rail section 24' when in the installed position of FIG. 5 of the drawings. The means for insuring retention of the assembled components of the insulator includes a plurality of pins or upstanding elements 47 projecting from the base of the cavity 32, each of which, prior to assembly with the insulator plate is provided with an upper surface 48 disposed above the plane of the surrounding peripheral walls of the pad 18'. Each of the upstanding elements 47 are intended to cooperate with a corresponding number of openings 49 extending vertically through the inner rail section 24' of the insulator plate such that when the two components illustrated in FIG. 6 are assembled with the insulator plate inner rail section disposed within the pad cavity 32, the pins 47 provide a close fit within the openings 49 with their upper surfaces 48 disposed above the plane of the top surface 38 of the insulator plate whereafter these surfaces 48 of the pins are staked as at 50 in the view of FIG. 5. As previously indicated, alternative methods of providing the fixed attachment of the dielectric pad to the insulator plate may be employed. The key requirement is that a rigid attachment be obtained between the two components of the insulator and therefore any suitable means providing a tight frictional fit therebetween may be utilized such as a press fit, snap fit or shrink fit.

The embodiment shown in FIG. 7 of the drawings relates to an alternate form of insulator 9' wherein the plate 17' and dielectric pad 18'' are modified such that the pad 18'' comprises a single thickness, substantially L-shaped element including the planar base 30' joined to a downwardly directed flange 31'. The inner rail section 24'' is formed with the planar portion 56 intended to overlie the rail base flange top surface 29 and includes an integral depending rail edge engaging flange 57 extending between the two side sections 28—28. Thus, instead of a dielectric pad captively surrounding an insulator inner rail section as in the previously described embodiments, this modification proposes a substantially L-shaped pad 18'' suitably affixed, such as by adhesive, to the inner surfaces of a mating inner rail section 24'' and rail edge engaging flange 57 and which is utilized with the same shoulder 7 and clip 10.

The first two described embodiments are intended to provide an insulated rail fastener assembly 1 designed to offer more reliable service such as would be required in a heavy-traffic main line installation while the alternative insulator 9' may be more economical to employ in meeting the service requirements of a side track installation.

I claim:

1. A fastener for securing a rail base flange to a cross-tie having a top surface including, a shoulder member fixed relative said cross-tie and provided with a head projecting above said cross-tie top surface adjacent said rail base flange, an insulator comprising a metal plate having an aperture intermediate an outer tie section and inner rail section, a dielectric pad underlying said inner rail section, side sections joining said outer tie and inner rail sections and defining opposed edges of said aperture, said insulator sections surrounding said shoulder member with the peripheral limits of said head disposed through said aperture, said outer tie section disposed atop said cross-tie top surface on one side of said shoulder head and said inner rail section on another side of said shoulder head and overlying said rail base flange with said dielectric pad engaging said rail base flange, a spring clip having legs engaging said shoulder head above said insulator and having inside and outside portions respectively bearing down upon said inner rail section and outer tie section of said insulator.

2. A fastener according to claim 1 wherein, said dielectric pad is fixedly attached to said insulator plate.

3. A fastener according to claim 2 wherein, said dielectric pad includes an upstanding element and said inner rail section is provided with a mating opening receiving said upstanding element.

4. A fastener according to claim 3 wherein, said upstanding element is staked over said inner rail section.

5. A fastener according to claim 2 wherein, said dielectric pad is dimensionally stable and substantially non-deformable in use with said insulator plate.

6. A fastener according to claim 2 wherein, said dielectric pad is staked about a substantial portion of the periphery of said inner rail section.

7. A fastener according to claim 2 wherein, said dielectric pad is adhesively secured to said inner rail section.

8. A fastener according to claim 1 wherein, said rail base flange includes an edge spaced from said shoulder head and said dielectric pad is provided with a base intermediate said inner rail section and rail base flange and an integral downwardly directed flange intermediate said rail base flange edge and shoulder head.

9. A fastener according to claim 8 wherein, said dielectric pad is staked about a substantial portion of the periphery of said inner rail section.

10. A fastener according to claim 8 wherein, said dielectric pad includes opposed first and second edge walls and opposed end walls projecting upwardly from said base and defining a cavity therebetween, said inner rail section disposed within said cavity and said first and second edge walls staked over said inner rail section.

11. A fastener according to claim 8 wherein said dielectric pad includes opposed first and second edge walls and opposed end walls projecting upwardly from said base and defining a cavity therebetween and said inner rail section disposed within said cavity and frictionally retained therewithin.

12. A fastener according to claim 1 wherein, said shoulder head includes one or more cavities extending therethrough parallel to said rail base flange, and said spring clip legs are parallel and disposed through said one or more cavities.

13. A fastener according to claim 1 wherein, said insulator outer tie section includes a planar tie bearing surface on its underside and said insulator plate is inclined upwardly from said tie bearing surface to said inner rail section.

14. A fastener according to claim 1 wherein, the periphery of said shoulder head is rectangular and said insulator aperture defines a rectangular configuration providing a close mating fit about said shoulder head.

15. A fastener according to claim 1 wherein, said inner rail section comprises a planar portion having an edge juxtaposed said shoulder head and said inner rail section edge defines one edge of said insulator plate aperture.

16. A fastener according to claim 1 wherein, said inner rail section comprises a planar portion overlying said rail base flange and an integral depending flange disposed intermediate said rail base flange and shoulder head.

17. A fastener according to claim 1 wherein, said cross-tie is of a castable composition and said shoulder member includes a shank attached to said head and embedded within said cross-tie.

* * * * *